United States Patent [19]

Klick

[11] Patent Number: 5,005,841

[45] Date of Patent: Apr. 9, 1991

[54] MEANS AND METHOD OF A GAME BOARD FOR RECEIVING MAGNETIC PIECES

[76] Inventor: Alan B. Klick, 2185 Hanshaw Rd., Lot #36, Ithaca, N.Y. 14850

[21] Appl. No.: 405,568

[22] Filed: Sep. 8, 1989

[51] Int. Cl.[5] ..... A63B 65/02; A63F 3/02

[52] U.S. Cl. ..... 273/345; 273/239

[58] Field of Search ..... 273/345, 239; 40/600; 434/168, 190, 430

[56] References Cited

U.S. PATENT DOCUMENTS

| | | | |
|---|---|---|---|
| T984,007 | 7/1979 | Richardson | 273/157 |
| 2,562,089 | 7/1951 | Fishlove | 273/345 |
| 2,921,388 | 1/1960 | Stefaney | 434/430 |
| 3,093,919 | 6/1963 | Holtz | 273/239 X |
| 3,122,684 | 2/1964 | Genin | 317/159 |
| 3,618,955 | 11/1971 | Barnes | 273/157 |
| 3,876,207 | 4/1978 | Jones | 273/135 |
| 4,172,597 | 10/1979 | Smith et al. | 273/239 |
| 4,202,134 | 5/1980 | Morrison | 46/92 |
| 4,305,587 | 12/1981 | O'Grady | 273/345 |
| 4,469,331 | 9/1984 | Rinker | 273/157 |
| 4,625,969 | 12/1986 | Donnell | 273/157 |
| 4,674,752 | 6/1987 | Brothers | 273/254 |
| 4,676,509 | 6/1987 | Bishop | 273/239 |

FOREIGN PATENT DOCUMENTS

| | | | |
|---|---|---|---|
| 0109673 | 5/1984 | European Pat. Off. | 273/239 |

*Primary Examiner*—William H. Grieb

*Attorney, Agent, or Firm*—Ralph R. Barnard

[57] ABSTRACT

A new and improved game board for use as a receiver for magnetized game pieces. The game board comprises a metallic wire screen embedded between two layers of flexible plastic.

10 Claims, 1 Drawing Sheet

MEANS AND METHOD OF A GAME BOARD FOR RECEIVING MAGNETIC PIECES

BACKGROUND OF THE INVENTION

1. Field of the Invention

The present invention relates to game apparatus and more particularly to game apparatus involving the use of magnetic game pieces and magnetic interaction to secure the pieces to the game board.

2. Description of the Related Art

A number of games have been developed which involve the use of magnetism to secure the pieces to the game. These games include puzzle type games, bingo type games and dart or projectile type games.

O'Grady (U.S. Pat. No. 4,305,587) discloses a Magnetic Game and Method which involves a rigid backed game board which itself is magnetized to attract the projectiles thrown at it.

Bishop (U.S. Pat. No. 4,676,509) discloses a Molded Bingo Chip with Magnetic Structure Secured Therein. Bishop discloses a rather complicated bingo marker containing a preformed slot into which is placed a structure of magnetic material upon which another layer of material is placed and secured, thus sealing the magnetic structure in the bingo marker.

Smith et al. (U.S. Pat. No. 4,172,597) teaches a Magnetic Pick-up Device and Marker. Smith discloses a ferromagnetic device for attracting and picking up circular or disc-like marker means which comprise enmeshed magnetizable metallic screen.

Other inventions, including Jones (U.S. Pat. No. 3,876,207) and Genin (U.S. Pat. No. 3,122,684), disclose magnetized game boards designed to attract magnetic game pieces.

SUMMARY OF THE INVENTION

It is an objective of this invention to provide a new and improved game board which is durable, safe for children and which can be easily colored and designed.

It is another objective of this invention to provide a new and improved game board which is easy and economical to manufacture.

It is still another objective of this invention to provide a new and improved game board which can be washed in a conventional washing machine.

It is still another objective of this invention to provide a new and improved target board capable of interaction with magnetized projectiles.

Further objectives may be found in the following drawing, specification and claims.

The foregoing objectives are achieved by the present invention which includes a metallic wire screen embedded between two layers of flexible material, said metallic wire screen capable of magnetic interaction with permanently magnetized game pieces.

DETAILED DESCRIPTION OF THE INVENTION

The figures are intended for illustration purposes only and it is to be understood that numerous other modifications, shapes and embodiments may be devised which will also fall within the spirit and scope of the principles of this invention as defined in the attached claims.

Figure 1:
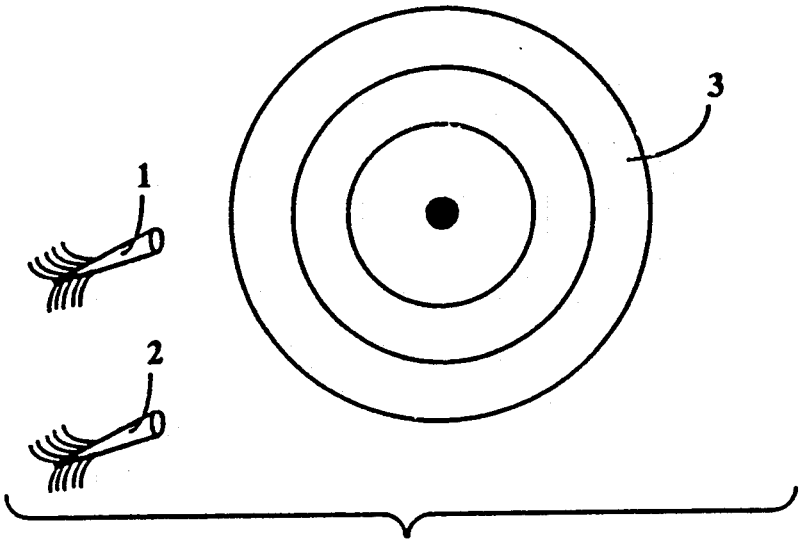
FIG. 1 is a frontal view of a magneticable game board used as a target with permanently magnetized projectiles.

FIG. 1 shows a game board (3) used as a target for a darttype game. Here the substantially flat surface is marked with a bullseye configuration. Other types of target markings, including other bullseye configurations, may also be used. Further, although two projectiles (1 & 2) are shown in the illustration, any number of projectiles may be used, said projectiles being of any shape, size or configuration so long as there is no interference with the magnetic attraction between target board and the tip of the projectile. Designs of said projectiles are known to those skilled in the art.

Figure 2:
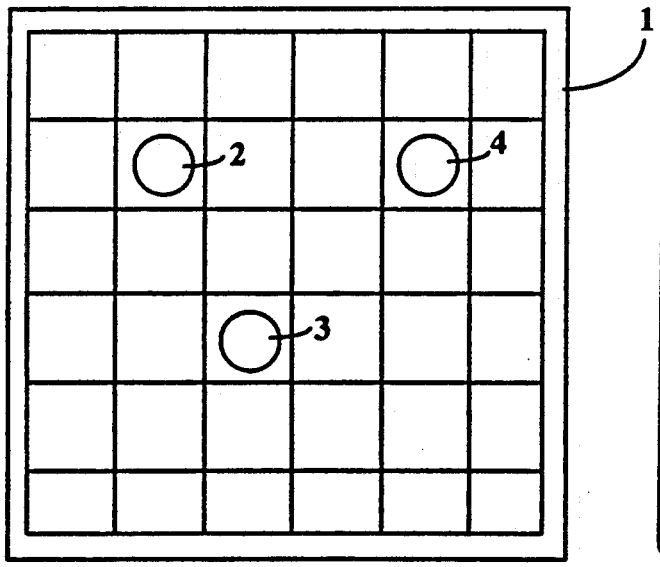
FIG. 2 is a frontal view of a magnetizable game board used with game pieces.

FIG. 2 shows an alternate embodiment of the invention, a game board (1) being used in a chess or checkers type game, with game pieces (2 & 3) shown adhering to said game board. As in the first embodiment, there can be any number of game pieces of any shape, size or configuration. Designs of said game pieces for use in chess or checkers type games are known to those skilled in the art. In this illustration, the surface of the board is marked off into squares of equal size. The number of subdivisions shown in FIG. 2 are for purposes of illustration only and are not indicative of any actual game board configuration. These subdivisions may b=further characterized by addition of color.

The embodiment of FIG. 2, without the addition of subdivisions, may also be used as a bulletin board type of game board.

Figure 3:
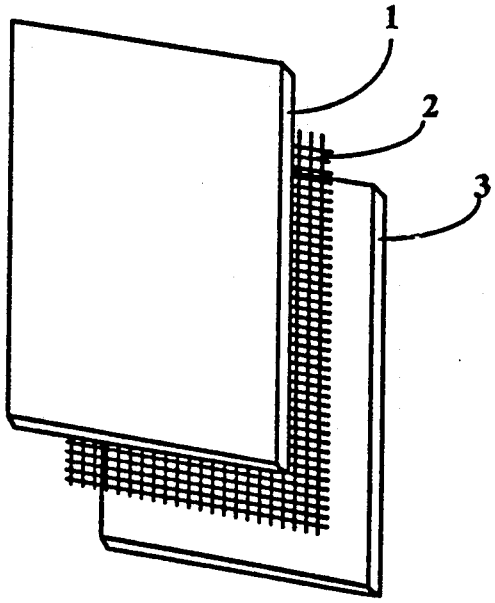
FIG. 3 is an exploded side view of a magnetizable game board of the invention, showing the layers of the material.

FIG. 3 illustrates the inter-relation between the metallic wire screen (2) and the layers of flexible material (1 & 3). The shape of the game board as shown in FIG. 3 is for purposes of illustration only and is not a limitation of the scope of the invention. The metallic wire screen may be composed of any metallic wire which has the ability to be magnetizable. The choice of metallic material will most likely be dictated by cost.

The flexible material which surrounds the metallic wire screen can be composed of any number of materials, such as plastic, rubber or some other resin. The only limitation to the flexible material which surrounds the wire screen is that it does not interfere with the magnetic interaction between the wire mesh screen and the permanently magnetized game piece or projectile.

The game board of this invention may be manufactured by a number of methods. One method involves forming a metallic wire screen of appropriate size, cutting said screen to the desired shape and dipping said screen into a vat of liquid plastic or rubber in order to form a coating on the metallic wire screen. The dipping step is repeated until the layers of plastic or rubber are of sufficient thickness.

Another method of manufacturing the game board of this invention is by overlaying a layer of uncured plastic or rubber material with a metallic wire screen and a second layer of uncured plastic or rubber material. This composite is cured, then cut to the desired shape and size.

Yet another method of manufacturing the game board of this invention is by forming a metallic wire screen, running said metallic wire screen through a roller process by which it is immersed in a pan of uncured plastic, run through a set of squeegees to remove excess plastic, and cured by blowing with warm air. The whole process may be repeated any number of times until the layers of plastic are of sufficient thickness.

There are several advantages to using a metallic wire screen rather than permanently magnetized material embedded within the game board, as was disclosed in O'Grady. When both game board and game pieces or projectiles contain permanently magnetized material, said game pieces or projectiles will not adhere to the surface of the game board unless the magnetic alignment is correct. If the game board is a target board containing permanently magnetized material and projectiles contain magnetizable material, the magnetic attraction between said projectiles and the target board is less than if said projectiles contained permanently magnetized material, i.e. were magnetized projectiles. Thus, the better form of a magnetic target game is to use permanently magnetized projectiles in conjunction with a magnetizable target board.

Use of metallic wire screen is still preferable to use of metallic pieces embedded in a game board. Although use of metallic pieces in a game board would create the necessary magnetic attraction between board and pieces, the random location of the metallic pieces within said game board precludes formation of a constant and steady magnetic field on the surface of the game board such that, at any given point on the board, the magnetic attraction will be substantially equal to the magnetic attraction at any other given point on the surface of the board. This steady magnetic field can be created by use of a metallic wire screen within said game board. In fact, the finer the weave of the wire screen, the more substantially equal will be the magnetic attraction at any given point of the board to any other given point of the board.

Another advantage to a game board composed of a metallic wire screen embedded within flexible material is that children will be less likely to be able to injure themselves on a game board which folds and has no sharp edges, than they would with game boards currently in use.

The foregoing description has been directed to particular embodiments of the invention in accordance with the requirements of the Patent Statutes for the purposes of illustration and explanation. It will be apparent, however, to those skilled in this art that many modifications and changes will be possible without departure from the scope and spirit of the invention. It is intended that the following claims be interpreted to embrace all such modifications.

What is claimed is:

1. A new and improved game board for use as a magnetizable receiver for permanently magnetized game pieces or projectiles, said game board comprising a metallic wire screen fixedly embedded between two layers of flexible material, wherein said game board has a substantially flat surface and said embedded metallic wire screen is capable of magnetic interaction with said permanency magnetized game pieces.

2. The game board of claim 1 wherein said game board is sufficiently flexible to be run through a washing machine without suffering any significant damage.

3. The game board of claim 1 wherein said flexible material is plastic.

4. The game board of claim 3 wherein said flexible material is clear plastic.

5. The game board of claim 3 wherein said game board is a bulletin board.

6. The game board of claim 1 wherein said substantially flat surface contains scoring indicia.

7. The game board of claim 6 further comprising means for maintaining said game board in a vertical attitude.

8. The game board of claim 1 wherein said substantially flat surface is divided into a plurality of separate and identifiable sections.

9. A new and improved method of associating permanently magnetized game pieces or projectiles with a receiver or target, comprising the steps of:

a. making a receiver or target of magnetizable material with a flat surface by fixedly embedding a metallic wire screen within flexible non-metallic material, b. making a plurality of permanently magnetized game pieces or projectiles, each having a flat surface, c. delivering or throwing said magnetized game pieces or projectiles to said magnetizable receiver or target whereby a magnetic binding of one or more of the game pieces or projectiles with the magnetizable receiver is completed.

10. The method of claim 9 wherein said flat surface of said magnetizable receiver is further marked out into area subdivisions associated with the game or the target.

* * * * *